US009512746B2

(12) United States Patent
Baltrucki et al.

(10) Patent No.: US 9,512,746 B2
(45) Date of Patent: Dec. 6, 2016

(54) APPARATUS AND SYSTEM COMPRISING COLLAPSING AND EXTENDING MECHANISMS FOR ACTUATING ENGINE VALVES

(71) Applicant: Jacobs Vehicle Systems, Inc., Bloomfield, CT (US)

(72) Inventors: Justin Baltrucki, Farmington, CT (US); Gabriel Roberts, Wallingford, CT (US); G. Michael Gron, Jr., Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 102 days.

(21) Appl. No.: 14/561,908

(22) Filed: Dec. 5, 2014

(65) Prior Publication Data

US 2015/0159521 A1 Jun. 11, 2015

Related U.S. Application Data

(60) Provisional application No. 61/912,535, filed on Dec. 5, 2013, provisional application No. 62/052,100, filed on Sep. 18, 2014.

(51) Int. Cl.
*F01L 1/18* (2006.01)
*F01L 1/24* (2006.01)

(52) U.S. Cl.
CPC ... *F01L 1/24* (2013.01); *F01L 1/18* (2013.01)

(58) Field of Classification Search
CPC ..... F01L 1/18; F01L 1/24
USPC ..... 123/90.12, 90.39, 90.44, 90.45, 90.46
See application file for complete search history.

(56) References Cited

U.S. PATENT DOCUMENTS

| | | | |
|---|---|---|---|
| 3,809,033 | A | 5/1974 | Cartledge |
| 4,656,976 | A | 4/1987 | Rhoads |
| 5,609,133 | A | 3/1997 | Hakansson |
| 6,253,730 | B1 | 7/2001 | Gustafson |
| 6,257,201 | B1 | 7/2001 | Kajiura et al. |
| 6,293,238 | B1 | 9/2001 | Harmon |

(Continued)

FOREIGN PATENT DOCUMENTS

| | | |
|---|---|---|
| JP | 59-43912 A | 3/1984 |
| WO | WO9932773 | 7/1999 |

OTHER PUBLICATIONS

International Search Report and Written Opinion mailed on Feb. 23, 2015 in PCT/US2014/068854, 13 pages.

*Primary Examiner* — Ching Chang
(74) *Attorney, Agent, or Firm* — Moreno IP Law LLC

(57) ABSTRACT

An apparatus and system for actuating at least one engine valve includes a rocker arm having a collapsing mechanism and an extending mechanism. The rocker arm may be configured as an exhaust rocker arm or an intake rocker arm. The collapsing mechanism is disposed at a motion receiving end of the rocker arm and is configured to receive motion from a primary valve actuation motion source. The extending mechanism is disposed in the rocker arm and configured to convey auxiliary valve actuation motions to the at least one engine valve. In a first embodiment, the extending mechanism is disposed at a valve actuation end of the rocker arm, whereas in a second embodiment, the extending mechanism is disposed at the motion receiving end of the rocker arm. Supply of fluid to a first and a second fluid passage controls operation of the extending and collapsing mechanisms, respectively.

21 Claims, 14 Drawing Sheets

(56) References Cited

U.S. PATENT DOCUMENTS

| | | | | |
|---|---|---|---|---|
| 6,394,067 | B1 | 5/2002 | Usko et al. | |
| 6,422,186 | B1 | 7/2002 | Vanderpoel | |
| 6,854,442 | B2 | 2/2005 | Satapathy et al. | |
| 6,983,725 | B2 | 1/2006 | Persson | |
| 7,007,650 | B2 | 3/2006 | Harmon | |
| 7,140,333 | B2 | 11/2006 | Persson et al. | |
| 7,392,772 | B2 | 7/2008 | Janak et al. | |
| 7,823,553 | B2 | 11/2010 | Meistrick | |
| 8,297,242 | B2 | 10/2012 | Persson et al. | |
| 8,602,000 | B2 | 12/2013 | Yoon et al. | |
| 8,627,791 | B2 | 1/2014 | Janak et al. | |
| 9,068,478 | B2 * | 6/2015 | Roberts | F01L 1/181 123/90.39 |
| 2006/0005796 | A1 | 1/2006 | Janak et al. | |
| 2011/0073068 | A1 * | 3/2011 | Yoon et al. | |
| 2013/0306016 | A1 | 11/2013 | Kato | |
| 2014/0020654 | A1 | 1/2014 | Yang | |
| 2014/0083381 | A1 | 3/2014 | Roberts et al. | |

* cited by examiner

APPARATUS AND SYSTEM COMPRISING COLLAPSING AND EXTENDING MECHANISMS FOR ACTUATING ENGINE VALVES

CROSS-REFERENCE TO RELATED APPLICATION

The instant application claims the benefit of Provisional U.S. patent application Ser. No. 61/912,535 entitled "INTEGRATED ROCKER SYSTEM" and filed Dec. 5, 2013, and Provisional U.S. patent application Ser. No. 62/052,100 entitled "DOUBLE ROLLER ROCKER WITH LOBE DEACTIVATION AND AUXILIARY VALVE MOTION PICK-UP" and filed Sep. 18, 2014, the teachings of which are incorporated herein by this reference.

FIELD

The instant disclosure relates generally to internal combustion engines and, in particular, to an apparatus and system for actuating engine valves.

BACKGROUND

Internal combustion engines typically use either a mechanical, electrical, or hydro-mechanical valve actuation system to actuate the engine valves. These systems may include a combination of camshafts, rocker arms and pushrods that are driven by the engine's crankshaft rotation. When a camshaft is used to actuate the engine valves, the timing of the valve actuation may be fixed by the size and location of the lobes (i.e., cams) on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder.

Additional auxiliary valve events, while not required, may be desirable and are known to provide alternative flow control of gas through an internal combustion engine in order to, for example, provide vehicle engine braking. For example, it may be desirable to actuate the exhaust valves for compression-release (CR) engine braking, bleeder engine braking, exhaust gas recirculation (EGR), brake gas recirculation (BGR), or other auxiliary valve events. Furthermore, other positive power valve motions, generally classified as variable valve actuation (VVA) event, such as but not limited to, early intake valve opening (EIVC), late intake valve closing (LIVC), early exhaust valve opening (EEVO) may also be desirable. Further still, cylinder deactivation (or variable displacement), in which engine valves remain closed and fuel is not provided to a given cylinder thereby effectively removing that cylinder from positive power production, may be desirable to improve engine operating efficiency under comparatively low load conditions.

One method of adjusting valve timing and lift given a fixed cam profile has been to incorporate a lost motion device in the valve train linkage between the valve and the cam. Lost motion is the term applied to a class of technical solutions for modifying the valve motion dictated by a fixed cam profile with a variable length mechanical, hydraulic or other linkage assembly. In a lost motion system a cam lobe may provide the maximum dwell (time) and greatest lift motion needed over a full range of engine operating conditions. A variable length system may then be included in the valve train linkage intermediate of the valve to be opened and the cam providing the maximum motion to subtract or "lose" part or all of the motion imparted by the cam to the valve. This variable length system, or lost motion system may, when expanded fully, transmit all of the cam motion to the valve and when contracted fully transmit none or a minimum amount of the cam motion to the valve.

Such known conventional systems may not provide the desired level of engine braking power, particularly in the case of downsized engines and/or heavier loads requiring more braking power than currently available with conventional compression release engine braking. It is known that engine braking valve motion with a second compression release event (i.e., 2-stroke engine braking) can provide the necessary braking power from the engine brake. Unfortunately, however, many engines do not have sufficient room to include the necessary components to effect the various above-noted auxiliary valve events, particularly those related to 2-stroke engine braking. To overcome such space issues, it is possible to incorporate such components into relatively large (and consequently expensive) overhead housings.

Thus, it would be advantageous to provide solutions for engine braking and other auxiliary valve movement regimes that overcome the limitations of conventional systems.

SUMMARY

The instant disclosure describes an apparatus and system for actuating at least one engine valve based on a rocker arm having a collapsing mechanism and an extending mechanism. The rocker arm may be configured as an exhaust rocker arm or an intake rocker arm. The collapsing mechanism is disposed at a motion receiving end of the rocker arm and is configured to receive motion from a primary valve actuation motion source. The collapsing mechanism may comprise a contact surface to receive primary valve actuation motions from the primary valve actuation motion source. The extending mechanism is disposed in the rocker arm and configured to convey auxiliary valve actuation motions to the at least one engine valve. In a first embodiment, the extending mechanism is disposed at a valve actuation end of the rocker arm, whereas in a second embodiment, the extending mechanism is disposed at the motion receiving end of the rocker arm. A first fluid passage is in communication with the extending mechanism and a second fluid passage is in communication with the collapsing mechanism. Supply of fluid to the first and second fluid passages controls operation of the extending and collapsing mechanisms, respectively.

In the first embodiment, the extending mechanism may be configured to actuate only a first engine valve of the at least one engine valve according to auxiliary valve actuation motions, whereas a primary valve actuator at the valve actuation end of the rocker arm may be configured to actuate the at least one engine valve according to the primary valve actuation motions. Further in accordance with the first embodiment, the rocker arm may comprise a fixed member disposed at the motion receiving end of the rocker arm and comprising a contact surface to receive the auxiliary valve actuation motions from an auxiliary valve actuation motion source. In the second embodiment, the extending mechanism may comprise a contact surface to receive the auxiliary valve actuation motions from an auxiliary valve actuation motion source.

In either the first or second embodiment, a control valve may be provided to supply and check fluid to the first fluid passage, and to vent fluid from the first fluid passage when a source of fluid to the control valve is removed. Additionally, the control valve may be used to supply fluid to the second fluid passage, which supply may be timed or staged to be after supply of fluid to the first fluid passage. In this manner, a single fluid supply source may be used in conjunction with the control valve to supply both the first and second fluid passages. Alternatively, first and second fluid supply sources may be used to supply fluid to the first and second fluid passages, respectively. In the first embodiment, the control valve may also be configured to supply fluid to the contact surface of the fixed member.

BRIEF DESCRIPTION OF THE DRAWINGS

The features described in this disclosure are set forth with particularity in the appended claims. These features will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
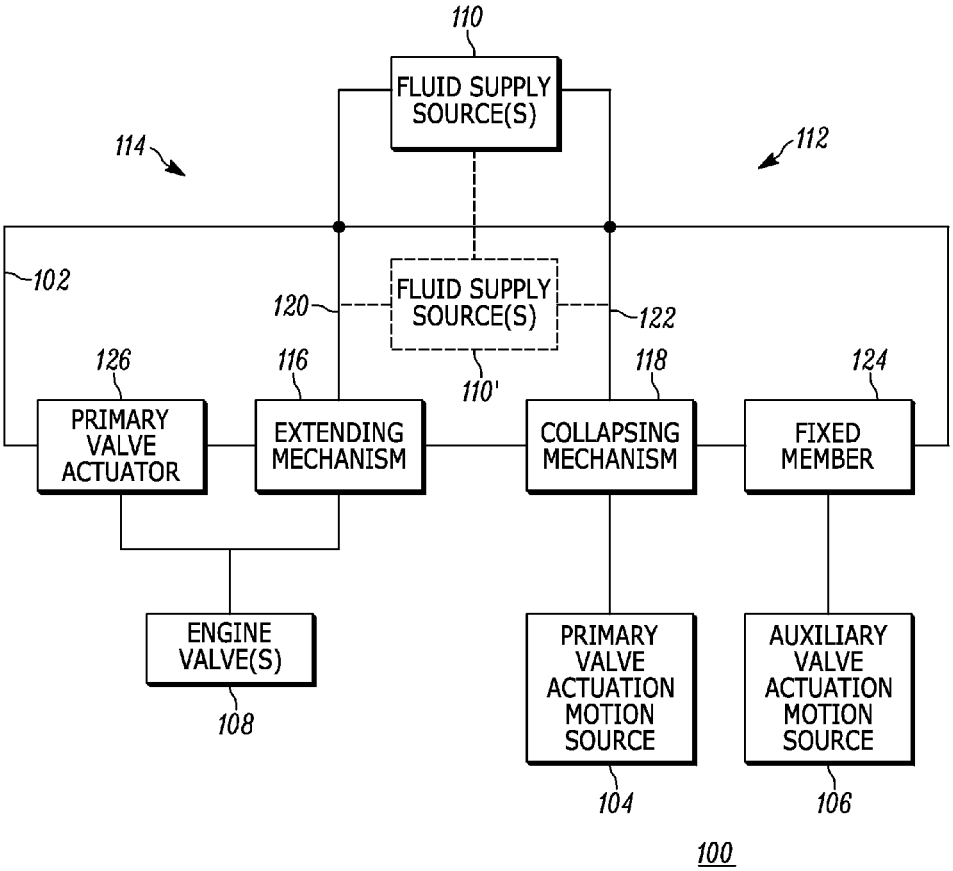
FIG. 1 is a schematic block diagram of an apparatus and system for actuating engine valves in accordance with a first embodiment of the instant disclosure.

FIG. 1 illustrates a schematic block diagram of an apparatus 102 and system 100 for actuating engine valves in accordance with a first embodiment of the instant disclosure. In particular, the system 100 may include a rocker arm 102, a primary valve actuation motion source 104, an auxiliary valve actuation motion source 106, at least one engine valve 108 and one or more fluid supply sources 110. As used herein, the descriptor "primary" refers to features of the instant disclosure concerning so-called main event engine valve motions, i.e., valve motions used during positive power generation, whereas the descriptor "auxiliary" refers to features of the instant disclosure concerning auxiliary engine valve motions, i.e., valve motions used during engine operation other than positive power generation (e.g., engine braking) or in addition to positive power generation (e.g., internal EGR). The rocker arm 102, which may be configured as an exhaust rocker arm or an intake rocker arm, comprises a motion receiving end 112 and a valve actuation end 114 with the respective ends 112, 114 being defined according to either side of an axis about which the rocker arm 102 reciprocates. As known in the art, the rocker arm 102 reciprocates according to valve motions received at the motion receiving end 112 from the primary valve actuation motion source 104 and/or the auxiliary valve actuation motion source 106, and conveys such received valve motions to the one or more engine valves 108 via the valve actuation end 114.

The valve actuation motion sources 104, 106 may comprise any type of motion source used to provide desired engine valve motions as known in the art. For example, in one embodiment, the valve actuation motions sources 104, 106 may comprise cams residing on one or more overhead camshafts. Alternatively, the valve actuation motion sources 104, 106 may comprise pushrods as in the case of an overhead valve configuration. Regardless, the at least one engine valve 108 is typically a poppet-type valve having a suitable valve spring to bias the valve into a closed position. As known in the art, a valve bridge may be employed to control the application of valve motions to multiple engine valves through a single rocker arm. The fluid supply source(s) 110 may comprise any suitable fluid that may be used to pneumatically or hydraulically control extending and collapsing mechanisms through first and second fluid passages 120, 122, respectively, as described hereinbelow. In an embodiment, the fluid supply source(s) 110 may comprise one or more sources of low pressure engine oil. As illustrated in FIG. 1, the fluid supply source(s) 110 may be external to the rocker arm 102 or, optionally, the fluid supply source(s) 110' may include components internal to the rocker arm, examples of which are described in further detail below.

The rocker arm 102 of the first embodiment comprises an extending mechanism 116 disposed in the valve actuation end 114 of the rocker arm 102 and a collapsing mechanism 118 disposed in the motion receiving end 112 of the rocker arm 102. Generally, the extending mechanism 116 and collapsing mechanism 118 comprise devices capable of maintaining or assuming a refracted state when not deployed or not transferring input motion through the mechanism when extended and, oppositely, maintaining an extended state when deployed, and further being capable of conveying valve actuation motions while in their extended states. As further shown in FIG. 1, a first fluid passage 120 is provided in fluid communication between the fluid supply source(s) 110, 110' and the extending mechanism 116, and a second fluid passage 122 is provided in fluid communication between the fluid supply source(s) 110, 110' and the collapsing mechanism 118. In an embodiment, the extending mechanism 116 and the collapsing mechanism 118, while capable of similar operations, are controlled in opposite manners. That is, in one state (e.g., positive power generation), the collapsing mechanism 118 is controlled to be in its extended or locked state and the extending mechanism 116 is controlled to be in its retracted state. In another state (e.g., engine braking operation), the collapsing mechanism 118 is controlled to assume a retracted (collapsed or unlocked) state and the extending mechanism 116 is controlled to maintain its extended state. In this manner, the extending mechanism 116 and the collapsing mechanism 118 permit various valve actuation motions to be either lost or conveyed via the rocker arm 102, depending on the desired operating state, e.g., positive power or engine braking.

As shown, the extending mechanism 116 is configured to convey valve actuation motions to the at least one engine valve 108. More specifically, and as further illustrated in the various examples described below, the extending mechanism 116 is configured to convey auxiliary valve actuation motions, derived from the auxiliary valve actuation motion source 106, to the at least one engine valve 108. In one embodiment, the extending mechanism 116 is configured to convey the auxiliary valve actuation motions to only a first engine valve of the at least one engine valve 108 as in the case, for example, of a valve bridge having a sliding pin engaging one of the engine valves.

As further shown in FIG. 1, the collapsing mechanism 118 is configured to receive primary valve actuation motions from the primary valve actuation motion source 104. In an embodiment, the collapsing mechanism comprises a contact surface to receive the motions from the primary valve actuation motion source 104. As used herein, a contact surface may comprise any means used to receive such motions. For example, where the primary valve actuation motion source 104 is embodied by a cam on an overhead camshaft, the contact surface of the collapsing mechanism 118 may comprise a cam roller, tappet or surface of the collapsing mechanism configured to directly receive the motion. Alternatively, where the primary valve actuation motion source 104 is a pushrod, the contact surface may comprise a ball or socket implementation. The instant disclosure is not limited by the specific configuration of the contact surface employed by the collapsing member 118.

As further illustrated in FIG. 1, the rocker arm 102 in the first embodiment comprises a fixed member 124 disposed at the motion receiving end 112 and configured to receive auxiliary valve actuation motions from the auxiliary valve actuation motion source 106. The fixed member 124 differs from the collapsing mechanism 118 in that it is not capable of extending or retracting, i.e., it is rigidly formed. As illustrated in the examples below, the fixed member 124 may be configured such that it cannot receive motions from the auxiliary valve actuation motion source 106 when the collapsing member 118 is extended, but can receive the motions from the auxiliary valve actuation motion source 106 when the collapsing member 118 is retracted (collapsed or unlocked). As with the collapsing member 118, the fixed member 124 comprises a contact surface to receive the auxiliary valve actuation motions, which contact surface may likewise take any of the forms described above. Once again, the instant disclosure is not limited by the specific configuration of the contact surface employed by the fixed member 124.

With further reference to FIG. 1, the rocker arm 102 also comprises a primary valve actuator 126 at the valve actuation end 114 of the rocker arm 102. The primary valve actuator 126 is configured to convey primary valve actuation motions to the at least one engine valve 108. For example, the primary valve actuator 126 may comprise a so-called elephant foot or e-foot configured to contact a valve bridge. Furthermore, the primary valve actuator 126 may comprise a lash adjustment screw or the like, as known in the art.

Finally, it is noted that the particular ordering of the extending mechanism 116, collapsing mechanism 118, fixed member 124 and primary valve actuator 126 illustrated in FIG. 1 is not intended as a requirement, e.g., the primary valve actuator 126 need not be located more distally relative to the center of the rocker arm 102 than the extending mechanism 116.

Figure 2:
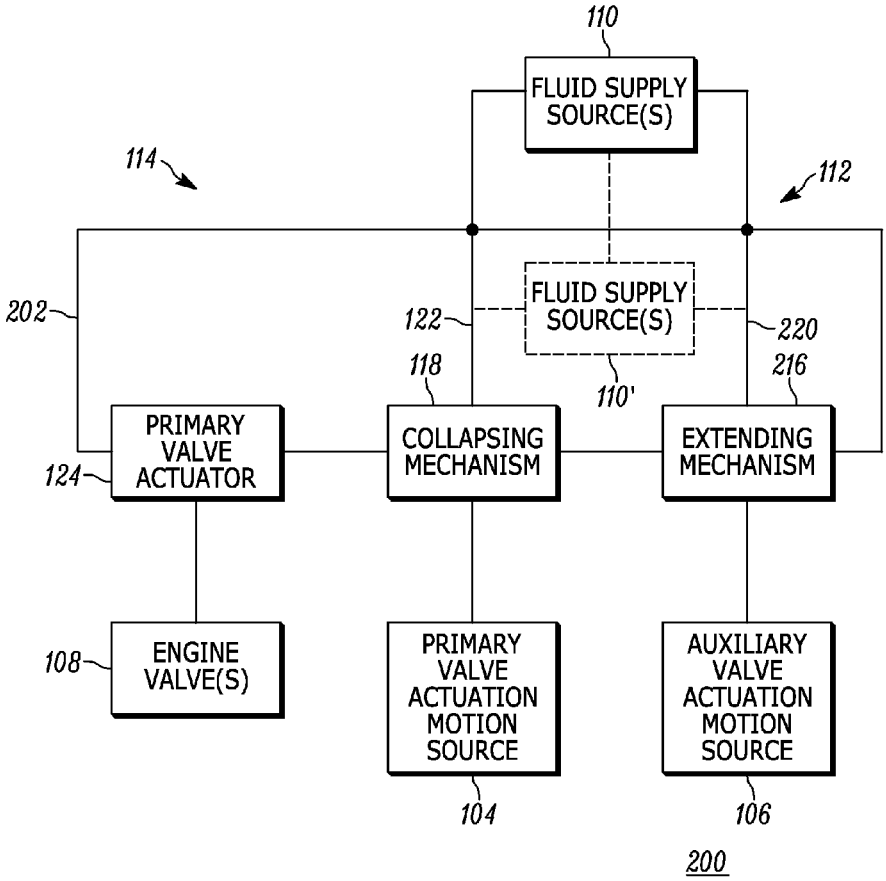
FIG. 2 is a schematic block diagram of an apparatus and system for actuating engine valves in accordance with a second embodiment of the instant disclosure.

FIG. 2 illustrates a schematic block diagram of an apparatus 202 and system 200 for actuating engine valves in accordance with a second embodiment of the instant disclosure. The system 200 is essentially the same as the system 100 illustrated in FIG. 2, with a few notable exceptions. In particular, the system 200 may include a rocker arm 202, the primary valve actuation motion source 104, the auxiliary valve actuation motion source 106, the at least one engine valve 108 and the one or more fluid supply sources 110, 110'. In this second embodiment, however, both the collapsing mechanism 118 and the extending mechanism 216 are at the motion receiving end 112 of the rocker arm 202. Consequently, the fixed member 124 is not included in the second embodiment. In this case, the primary valve actuator 124 is used to convey not only the primary valve actuation motions, but also the auxiliary valve actuation motions.

In this second embodiment, the extending mechanism 216 is configured to receive the auxiliary valve actuation motions from the auxiliary valve actuation motion source 106. In this embodiment, the extending mechanism 216 further comprises a contact surface to receive the auxiliary valve actuation motions, which contact surface may likewise take any of the forms described above. Once again, the instant disclosure is not limited by the specific configuration of the contact surface employed by the extending mechanism 216. Further in this second embodiment, a first fluid passage 220 is provided in fluid communication between the fluid supply source(s) 110, 110' and the extending mechanism 216 thereby permitting control of operation of the extending mechanism 216. Once again, the particular ordering of the extending mechanism 216 and the collapsing mechanism 118 illustrated in FIG. 2 is not intended as a requirement, e.g., the extending mechanism 216 need not be located more distally relative to the center of the rocker arm 202 than the collapsing mechanism 118.

Figure 14:
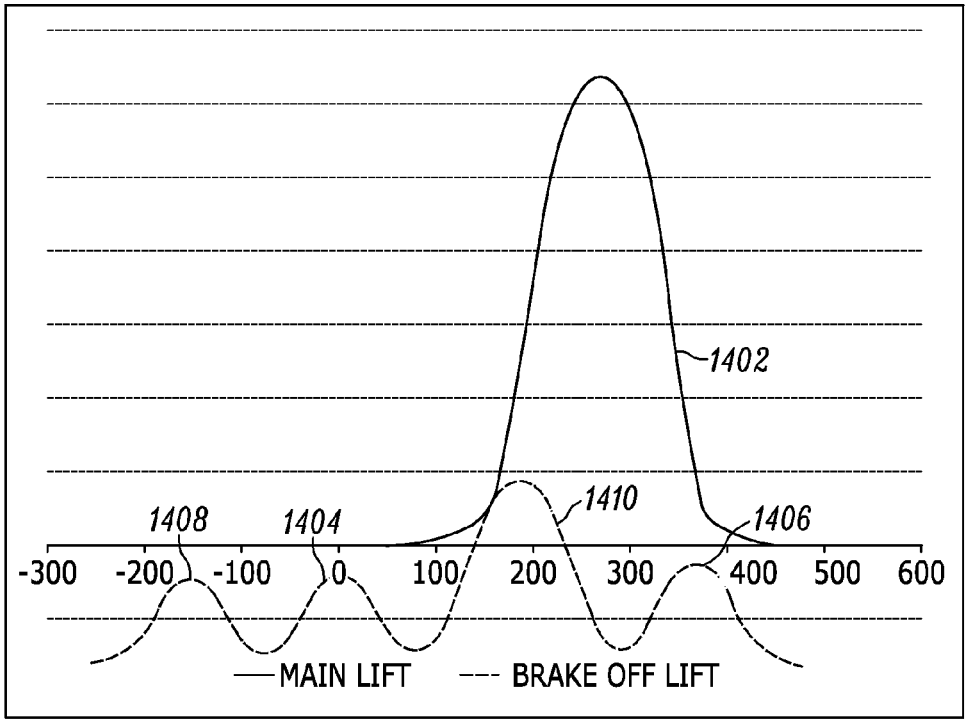
FIGS. 14 and 15 illustrate examples of cam profiles and valve movements in accordance with the instant disclosure.
Figure 15:
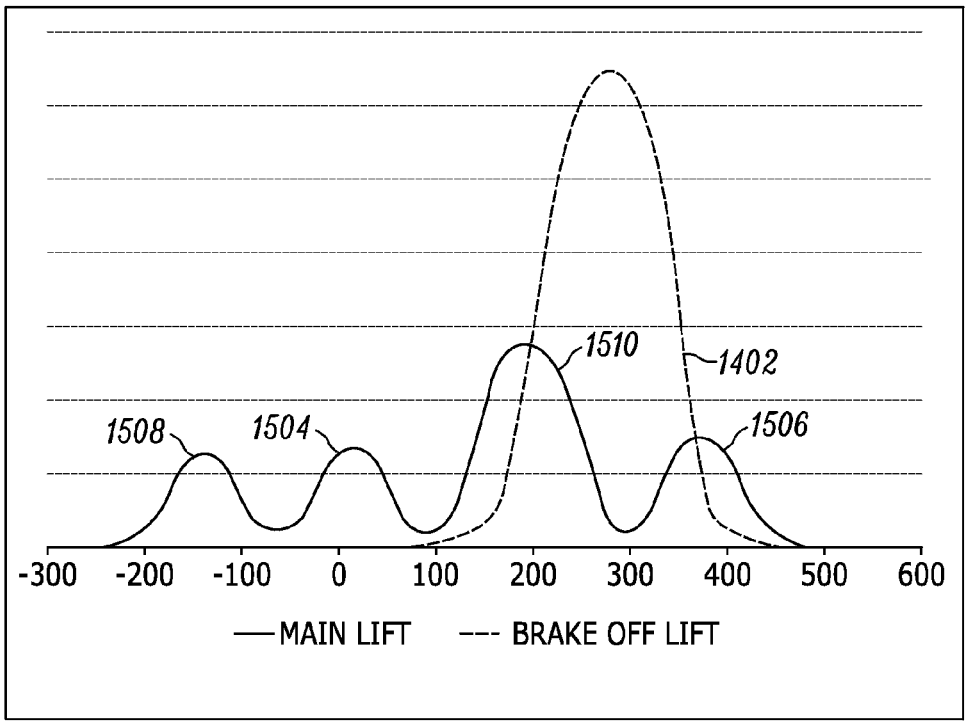

Through the controlled retraction or extension of the extending mechanism 116, 216 and collapsing mechanism 118 (via the first 120, 220 and second 122 fluid passages, respectively), motions from both the primary and auxiliary valve actuation motion sources 104, 106 can be selectively lost or conveyed to at least one engine valve 108 by the rocker arm 102, 202. Examples of such selective conveyance of valve actuation motion are illustrated in FIGS. 14 and 15. In particular FIGS. 14 and 15 illustrate the selective application of valve lifts to an exhaust valve when operating in a positive power generation mode (FIG. 14) and in a combined 2-stroke engine braking and BGR mode (FIG. 15). In both FIGS. 14 and 15, the cam profiles/valve motions are plotted along an horizontal axis expressed in degrees of crankshaft rotation. In accordance with convention, a full two rotations of a crankshaft are illustrated from −180 degrees to 540 degrees, with top dead center piston positioning occurring at 0 and 360 degrees and bottom dead center piston positioning at 180 and 540 (−180) degrees. Further in keeping with convention, crankshaft rotation between −180 degrees and 0 degrees corresponds to a compression phase; rotation between 0 degrees and 180 degrees corresponds to a power or expansion phase; rotation between 180 degrees and 360 degrees corresponds to an exhaust phase; and rotation between 360 degrees and 540 degrees (−180 degrees) corresponds to an intake phase.

With this context, FIG. 14 illustrates a main exhaust valve lift 1402 that, as known in the art, occurs mainly during the exhaust phase. In accordance with the first and second embodiments described above, the main exhaust valve lift 1402 provided by the primary valve actuation motion source 104 occurs (i.e., is conveyed to the exhaust valve 108 via the rocker arm 102, 202) when the collapsing mechanism 118 is in an extended or locked state. A profile of the auxiliary valve actuation motion source 106 is illustrated in FIG. 14 and comprises, in this example, two compression-release engine braking lobes 1404, 1406 (thereby providing 2-stroke engine braking) and two BGR lobes 1408, 1410. However, these auxiliary motions are not conveyed (i.e., they are lost) to the exhaust valve 108 due to the extending mechanism 116, 216 being maintained in a retracted or unlocked state. In contrast, FIG. 15 illustrates the condition of the collapsing mechanism 118 being maintained in a retracted or unlocked state such that the main exhaust valve lift 1402 is lost, as indicated by the dotted line. Contemporaneously, the extending mechanism 116 is maintained in an extended or locked state such motions 1404, 1406, 1408, 1410 provided by the auxiliary valve actuation motion source 106 are conveyed as compression-release valve motions 1504, 1506 and BGR valve motions 1508, 1510. Although FIGS. 14 and 15 illustrate particular examples of valve lifts in keeping with the instant disclosure, those having ordinary skill in the art that a variety of primary and auxiliary valve motions may be implemented in accordance with the instant teachings.

Various implementations of the first and second embodiments of FIGS. 1 and 2 are now described below relative to FIGS. 3-12.

Figure 3:
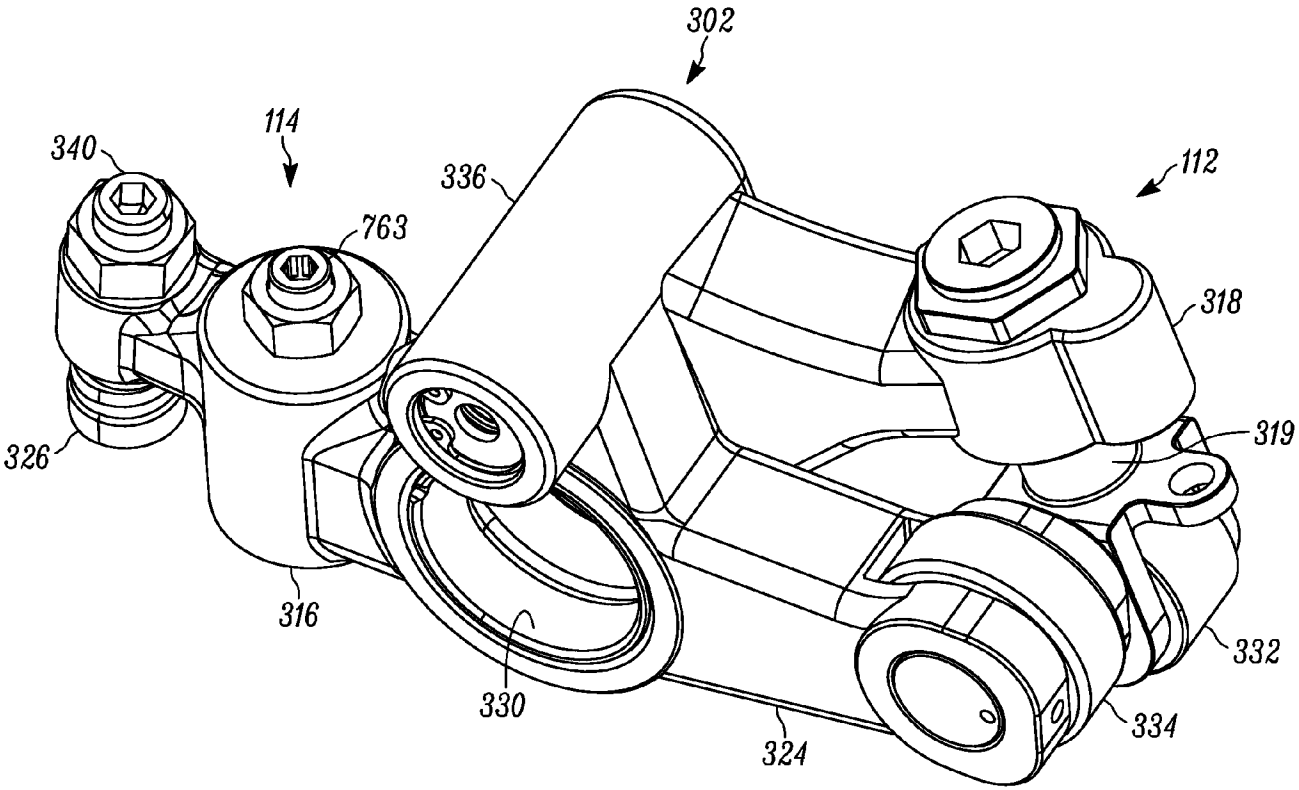
FIGS. 3 and 4 are top and bottom perspective views, respectively, of an implementation of a rocker arm in accordance with the first embodiment of the instant disclosure.
Figure 4:
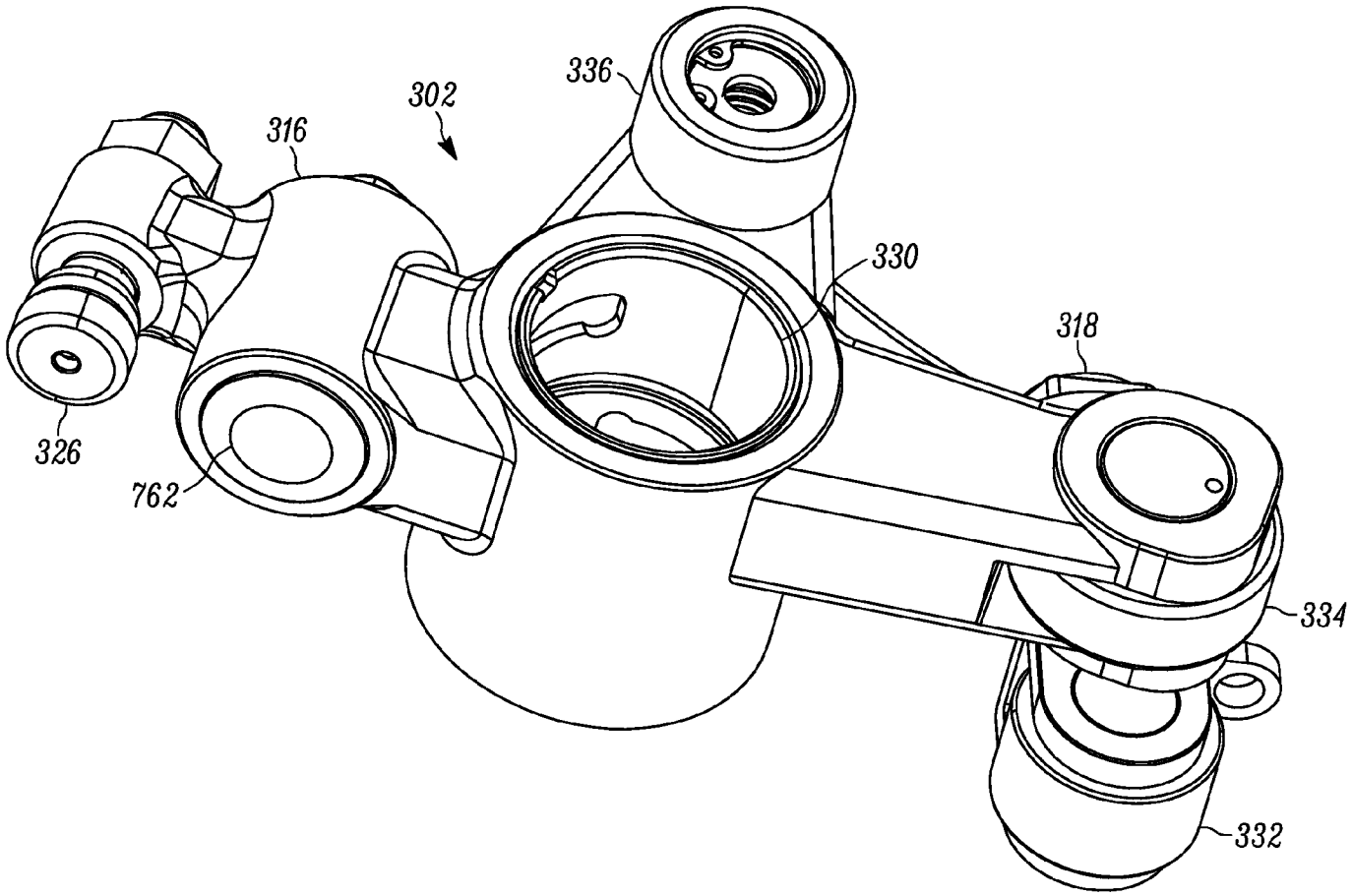
Figure 5:
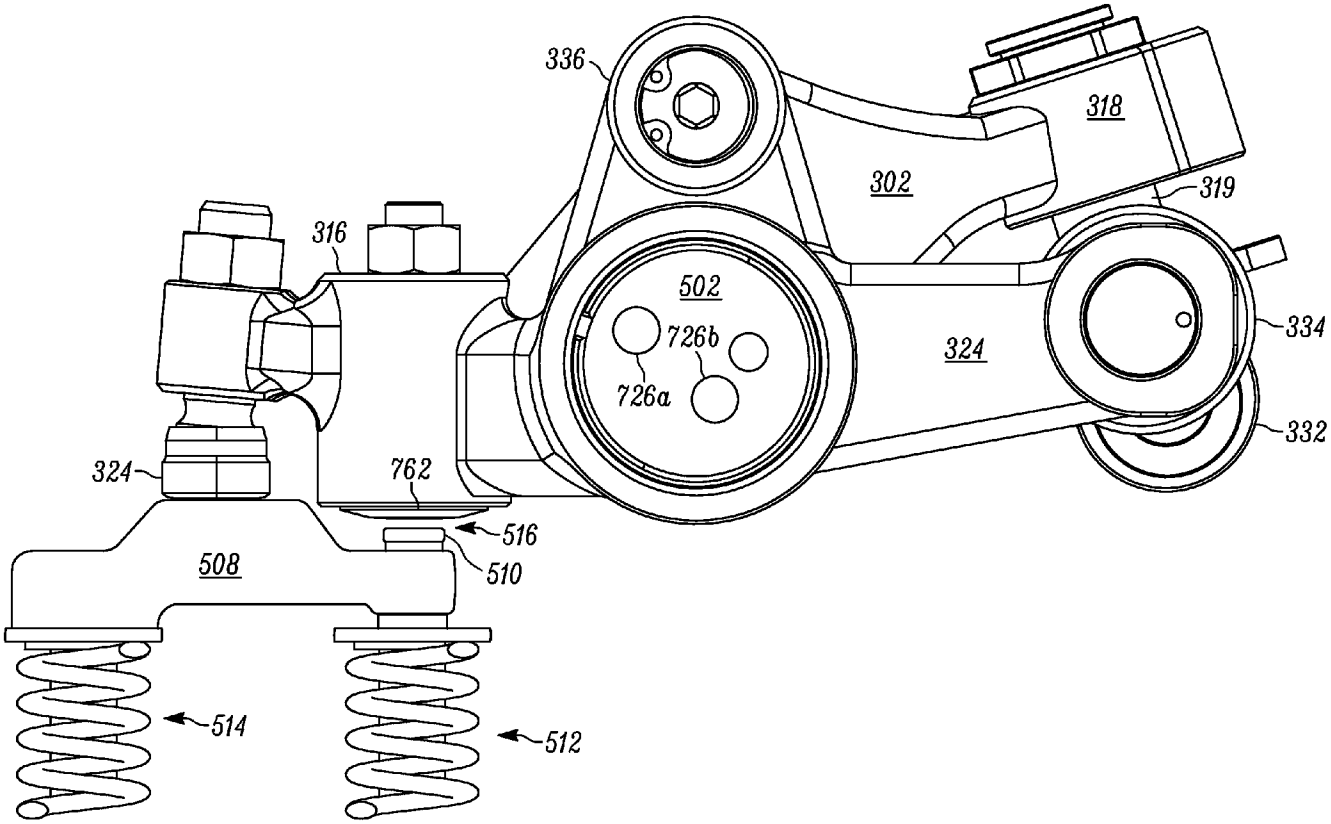
FIGS. 5 and 6 are side views of the implementation of FIGS. 3 and 4 illustrating operation of the rocker arm.

FIGS. 3 and 4 illustrate top and bottom perspective views, respectively, of an implementation of a rocker arm 302 in accordance with the first embodiment of FIG. 1. As in FIG. 1, the rocker arm 302 has a motion receiving end 112 and a valve actuation end 114. The rocker arm 302 has a rocker arm shaft bore 330 formed therein, which bore is configured to receive a rocker arm shaft 502 (FIG. 5). Dimensions of the rocker arm shaft bore 330 are chosen to permit the rocker arm 302 to reciprocally rotate about the rocker arm shaft 502. One or more fluid supply ports (not shown) may be formed on the interior surface defining the rocker arm shaft bore 330 and positioned to received fluid, such as engine oil, provided by one or more fluid channels formed in the rocker arm shaft 502.

The motion receiving end 104 of the rocker arm 102 is configured to receive valve actuation motions from both the primary valve actuation motion source and the auxiliary valve actuation motion source (not shown) via respective contact surfaces. In the illustrated embodiment, the contact surfaces are embodied by a primary cam roller 332 and an auxiliary cam roller 334, as would be the case where the primary and auxiliary valve actuation motion sources 104, 106 comprise cams residing on an overhead camshaft. In the illustrated embodiment, the primary cam roller 332 is attached to a collapsing mechanism 318 whereas the auxiliary cam roller 334 is attached to a fixed member 324. As shown, the cam rollers 332, 334 may be attached to their respective components via cam roller axles. However, as will be appreciated by those having ordinary skill in the art and as noted above, the cam rollers 332, 334 may be replaced, for example, with tappets configured to contact an overhead cam. In another alternative, as in the case where the primary and auxiliary valve actuation motion sources 104, 106 comprise pushrods, the rollers may be replaced by a ball or socket implementation. Once again, the instant disclosure is not limited in this regard.

As shown, the collapsing mechanism 318 may comprise a boss extending laterally from the rocker arm 302 having a bore formed therein. Within the bore of the collapsing mechanism 318, a collapsing piston 319 is disposed. In an embodiment, the collapsing piston 319 may be implemented as an outer plunger of a wedge locking mechanism. Such a wedge locking mechanism is described in co-pending U.S. patent application Ser. No. 14/331,982 filed Jul. 15, 2014 and entitled "Lost Motion Valve Actuation Systems With Locking Elements Including Wedge Locking Elements" (the "982 application"), the teachings of which are incorporated herein by this reference. As described therein, embodiments of the wedge locking mechanism applicable to the instant disclosure comprises one or more wedges disposed in side openings of an outer plunger and configured to engage an outer recess formed in a housing. In the absence of fluid actuation, a spring bias applied to an inner plunger disposed within the outer plunge causes the one or more wedges to be forced to radially protrude from the outer plunger and locked into engagement with the outer recess of the housing, thereby locking the outer plunger relative to the housing. Application of the actuating fluid to the inner plunger sufficient to overcome the spring bias applied to the inner plunger permits the one or more wedges to disengage from the outer recess of the housing, thereby permitting movement of the outer plunger relative to the housing.

In the context of the instant disclosure, where the collapsing piston 319 is implemented as the outer plunger of the '982 application, the absence of fluid in the second fluid passage 122 (not shown) permits the collapsing piston 319 to be locked relative to the boss of the collapsing mechanism 318. Conversely, supply of fluid to the second fluid passage 122 causes the wedge locking mechanism to unlock, thereby permitting movement of the collapsing piston 319 relative to the boss, i.e., the collapsing piston 319 is unlocked and any motion applied thereto will be lost.

In yet another implementation, various embodiments of a locking mechanism described in co-pending U.S. patent application Ser. No. 14/035,707 filed Sep. 24, 2013 and entitled "Integrated Lost Motion Rocker Brake With Automatic Reset" (the "'707 application"), the teachings of which are incorporated herein by this reference, may be used to implement the collapsing mechanism 318. In this case, the collapsing piston 319 may be implemented by the actuator piston taught therein, which actuator piston engages a spring-biased, fluid-actuated locking piston. In one position in which actuating fluid is not applied to the locking piston, the locking piston is aligned relative to the actuator piston such that the actuator piston (under the bias of a spring) is forced into a recess formed in the locking piston, thereby causing the actuator piston to assume a retracted position relative to its housing. Conversely, application of the actuating fluid causes translation of the locking piston such that the actuator piston is displaced from the recess and locked into an extended position relative to its housing.

Thus, in the context of the instant disclosure, where the collapsing piston 319 is implemented as the actuator piston of the '707 application, the absence of fluid in the second fluid passage 122 permits the collapsing piston 319 to be unlocked relative to the boss of the collapsing mechanism 318. Conversely, supply of fluid to the second fluid passage 122 causes the locking mechanism to lock, thereby preventing movement of the collapsing piston 319 relative to the boss. Note that the control of the respective locking mechanisms taught by the '982 and the '707 applications is reversed; application of control fluid to the locking device of the '982 application causes it to unlock and its absence causes the locking device to lock, whereas application of control fluid to the locking device of the '707 application causes it to lock and its absence causes the locking device to unlock.

Figure 7:
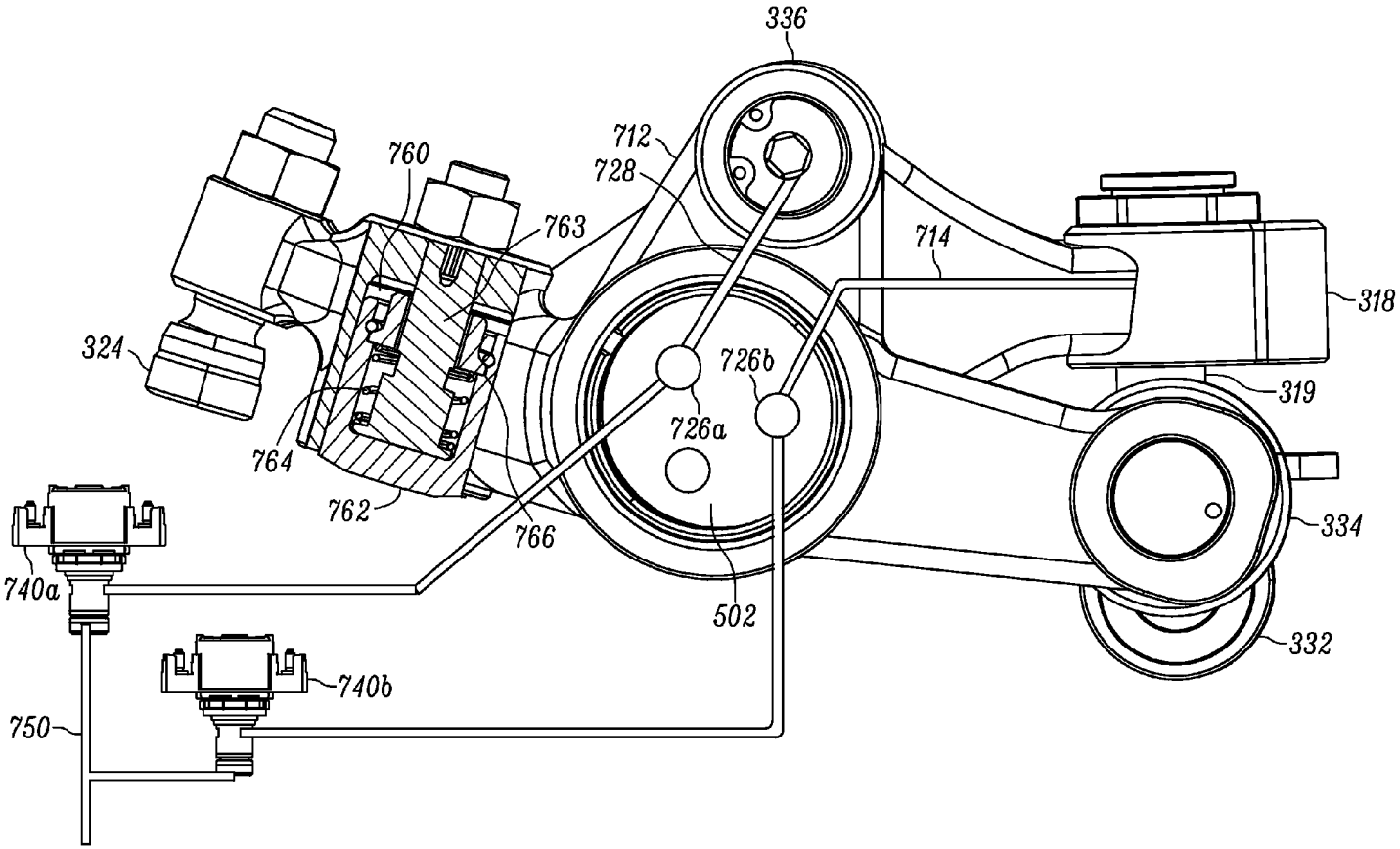
FIG. 7 is a partial cross-sectional side view of the implementation of FIGS. 3 and 4 and further illustrating an example of an extending mechanism and fluid supply components.

As further shown in FIGS. 3 and 4, the primary valve actuator 326 is located relatively more distally along the valve actuation end 114 of the rocker arm 302 than the extending mechanism 316. In the illustrated embodiment, the primary valve actuator 326 comprises a so-called "elephant's foot" (efoot) screw assembly 340 including a lash adjustment nut. Those having ordinary skill in the art will appreciate that the primary valve actuator 326 may be implemented using other, well-known mechanisms for coupling valve actuation motions to one or more engine valves. Like the collapsing mechanism 318, the extending mechanism 316 may comprise a boss formed in the valve actuation end 114 and having a bore formed therein in which a piston 762 (FIGS. 4 and 7) is disposed. An implementation of the extending mechanism 316 is illustrated in FIG. 7 in which the extending mechanism 316 is illustrated in cross-section. As shown in FIG. 7, the extending mechanism 316 comprises a lash adjustment screw 763 deployed in a bore 760. A piston 762 is positioned at the end of the lash adjustment screw 763 and at an open end of the bore 760. A spring 764 biases the piston 762 into the bore 760 by virtue of its deployment between the screw 763 and a ring 766 attached to the piston 762, as shown. The bore 760 is further in fluid communication with the first fluid passage 712. When no fluid is supplied by the first fluid passage 712 to the bore 760, the bias of the spring 764 causes the piston 762 to assume a retracted position within the bore 760. Conversely, when fluid is applied to the first fluid passage 712 and the bore 760, the force of the spring 764 is overcome and the piston 762 extends out of the bore 760.

As known in the art, the application of low pressure fluid, while sufficient to cause the piston 762 to extend out of its bore 760, is not sufficient to withstand the valve actuation forces applied to the rocker arm 302. As known in the art, however, a control valve 336 may be employed to hydraulically lock the fluid in the first fluid passage 712 and the bore 760, thereby also locking the piston 762 to a degree sufficient to withstand the valve actuation forces applied to the rocker arm 302. To the extent that the control valve 336 helps supply fluid to the first fluid passage 712, it can be considered as an internal part of the fluid supply source(s) 110'. As best shown in FIG. 3, the control valve housing 132 may be transversely aligned relative to a longitudinal axis of the rocker arm 302, though this is not a requirement. As described in greater detail below, the control valve 336 encloses a check valve used to regulate the flow of hydraulic fluid into an hydraulic circuit in fluid communication with the bore forming the extending mechanism 316. Further discussion of the control valve 336 is provided below relative to FIGS. 8-10.

As described above, the extending mechanism 316 can be implemented as an actuator piston 762 operating in conjunction with a control valve 336. However, it is understood that this is not a requirement. Indeed, the various locking mechanisms described above relative to the collapsing mechanism 318 may be equally employed to implement the extending mechanism 316. An advantage of the previously described locking mechanisms is that they can achieve a locking state based solely on the application (or removal) of low pressure fluid, thereby eliminating the need for a high pressure fluid circuit provided by the control valve 336.

Figure 6:
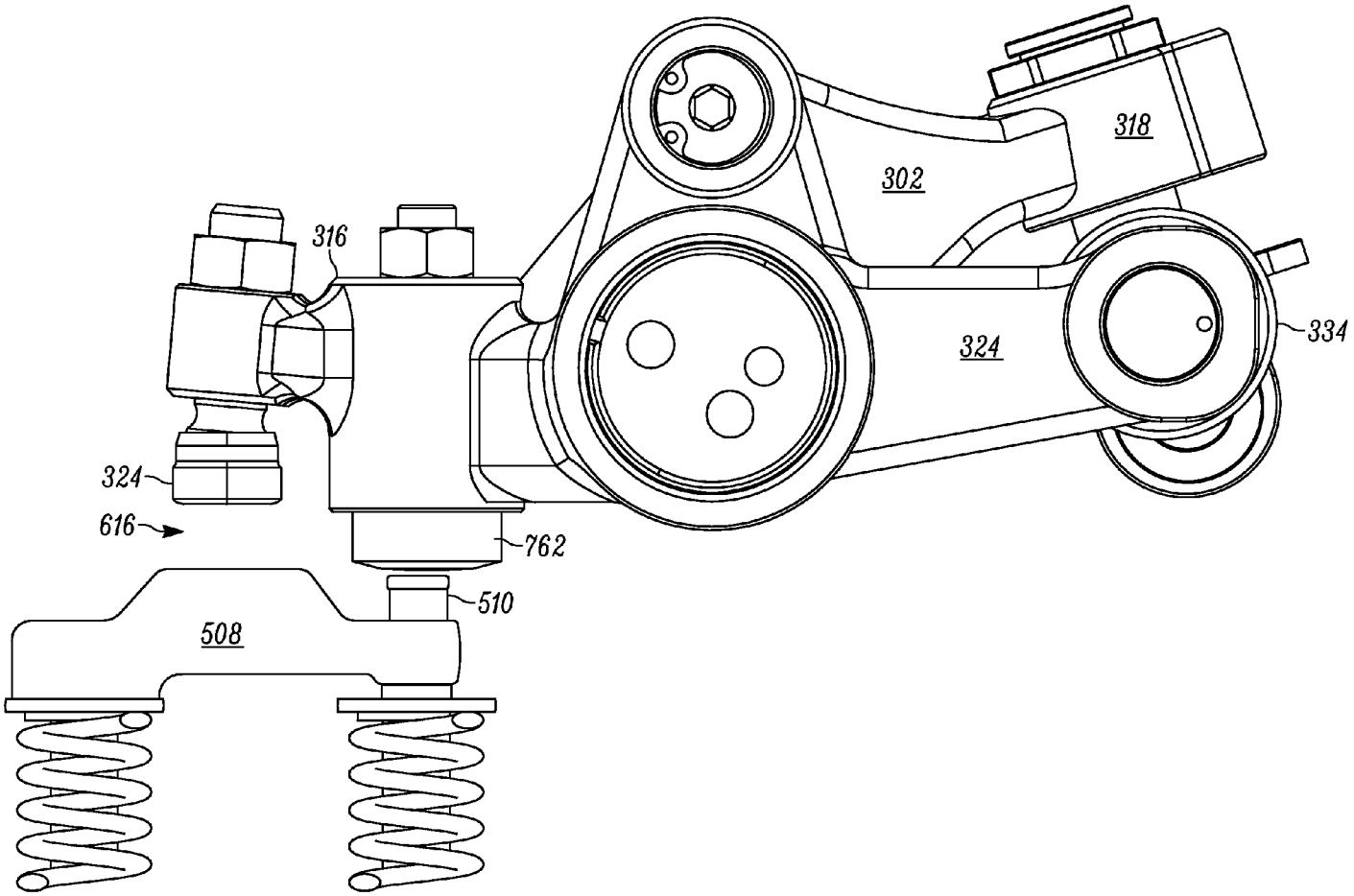

Referring now to FIGS. 5 and 6, side views of the implementation of FIGS. 3 and 4 are shown illustrating operation of the rocker arm 302. In particular, the rocker arm 302 is mounted on a rocker arm shaft 502 that, in the illustrated embodiment, includes a first fluid supply source **726*a* and a second fluid supply source 726*b*. Use of the first and second fluid supply source 726*a*, 726*b* to control operation of the extending mechanism 316 and the collapsing mechanism 318 is further described below relative to FIG. 7. As further shown, the rocker arm 302 is configured to contact a valve bridge 508 via the primary valve actuator 324. The valve bridge 508, in turn, contacts both a first engine valve 512 and a second engine valve 514. The valve bridge 508 further comprises a sliding pin 510 aligned with both a first engine valve 512 and the piston 762 of the extending mechanism 316**.

FIG. 5 illustrates operation of the rocker arm 302 during positive power generation. Consequently, the collapsing piston 309 is illustrated in its fully extended position such that the primary cam roller 332 contacts the primary valve actuation motion source (i.e., a primary cam; not shown), whereas the auxiliary cam roller 334 at the end of the fixed member 324 is maintained away from the auxiliary valve actuation motion source (i.e., an auxiliary cam; not shown). At the same time, the piston 762 of the extending mechanism 316 is maintained in its fully retracted position, such that a lash space 516 is maintained between the piston 762 and the sliding pin 510. As a result, the fixed member 324 (and, consequently, the rocker arm 302) does not receive any valve actuation motions from the auxiliary valve actuation motion source, whereas the collapsing mechanism 318 (and, consequently, the rocker arm 302) receives valve actuation motions from the primary valve actuation motion source. Given the lash space maintained between the piston 762 and the sliding pin 510, the primary valve actuation motions imparted to the rocker arm 302 are transferred to the first and second engine valves 512, 514 only via the primary valve actuator 324 and the valve bridge 508.

However, during operation of the rocker arm during an auxiliary mode of operation (i.e., other than positive power generation), as illustrated in FIG. 6, the collapsing piston 309 (not shown) is permitted to retract into the collapsing mechanism 318, resulting in all motion from the primary valve actuation motion source being lost relative to the rocker arm 302. At the same time, the piston 762 of the extending mechanism 316 is locked into its extended position such that it contacts the sliding pin 510. Consequently, a lash space 616 is formed between the primary valve actuator 324 and the valve bridge 508. This contact between the piston 762 and the sliding pin 510 also causes the rocker arm 302 to rotate (clockwise in FIG. 6) such that the auxiliary cam roller 332 is maintained in contact with the auxiliary valve actuation motion source. As a result, the fixed member 324 (and, consequently, the rocker arm 302) receive valve actuation motions from the auxiliary valve actuation motion source, whereas the valve actuation motions from the primary valve actuation motion source are lost, as noted above. In this case, the auxiliary valve actuation motions imparted to the rocker arm 302 are transferred to only the first engine valve 512 via the piston 762 of the extending mechanism 316 and the sliding pin 510. Given the lash space 616 maintained between the primary valve actuator 324 and the valve bridge 508, none of the auxiliary valve actuation motions are transferred to the valve bridge 508 and, consequently, the second engine valve 514.

In the embodiments of FIGS. 5 and 6, first and second fluid supplies 726*a*, 726*b* are provided. Referring now to FIG. 7, use of the first and second fluid supplies 726*a*, 726*b* are further described. In particular, the first and second fluid supplies 726*a*, 726*b* may be used as independent controls of the extending mechanism 316 and the collapsing mechanism 318, respectively. In the embodiment illustrated in FIG. 7, as described above, the collapsing mechanism 316 comprises an actuator piston 762 operating in conjunction with a control valve 336, whereas the collapsing mechanism 318 comprise a wedge locking mechanism of the type described in the '982 application. Thus, as shown, the control valve 336 is in fluid communication with the bore 760 via the first fluid passage 712, whereas the collapsing mechanism 318 is in fluid communication with the second fluid passage 714. A first fluid supply passage 728 provides fluid communication between the first fluid supply source 726*a* and the control valve 336, whereas the second fluid passage 714 is in direct fluid communication with the second fluid supply source 726*b*. This distinction between the first and second fluid passages 712, 714 (i.e., either communicating through the control valve 336 or directly with their respective fluid supply sources 726*a*, 726*b*) reflects the fact that the actuator piston embodiment of the extending mechanism 316 requires a high pressure circuit as provided downstream of the control valve 336.

As further shown in FIG. 7, the provision of fluids through the first and second fluid supply sources 726*a*, 726*b* are respectively controlled, for example, by respective solenoids 740*a*, 740*b*. Each of the solenoids 740*a*, 740*b* is connected to a common low pressure fluid source 750, such as engine oil. As known in the art, the solenoids 740*a*, 740*b* can be separately controlled electronically (via a suitable processor or the like, such as an engine controller; not shown) to permit fluid from the common fluid source 750 to flow to the respective first and second fluid supply sources 726*a*, 726*b* in the rocker arm shaft 502. Thus, given the above-noted assumptions about the implementations of the extending mechanism 316 and the collapsing mechanism 318, when fluid is not supplied by either the first or second fluid supply sources 726*a*, 726*b*, the extending mechanism 316 will be maintained in its retracted state and the collapsing mechanism 318 will be locked into its extended state. When fluid is permitted to flow by the first solenoid 740*a* through the first fluid supply source 726*a*, the extending mechanism 316 will be locked into its extended state (via operation of the control valve 336). Independently, when fluid is permitted to flow by the second solenoid 740*b* through the second fluid supply source 726*b*, the collapsing mechanism 316 will be unlocked thereby permitting the collapsing piston 319 to assume a retracted state. Once again, as noted above, the controlling sense of the fluid supply sources 726*a*, 726*b* (i.e., fluid absence=extended state, fluid presence=refracted state; and vice versa) is a function of the particular implementations of both the extending mechanism 316 and the collapsing mechanism 318, which may be selected as a matter of design choice.

In an embodiment, it may be desirable to initiate actuation of the extending mechanism 316 (i.e., to assume its extended state) prior to, or at least no later than, initiating actuation of the collapsing mechanism 318 (i.e., to assume its unlocked or retracted state) thereby avoiding, in the case of an exhaust valve, the risk of losing all valve opening motions before completely shutting off fuel to a cylinder during a transition from positive power generation to engine braking, for example. For example, with reference to FIGS. 14 and 15, the presence of an increased lift BGR valve motion 1410, 1510 ensures such "fail safe" exhaust valve opening. In the context of FIG. 7, the required timing could be achieved by virtue of the independently controlled solenoids 740*a*, 740*b*, i.e., by controlling the first solenoid 740*a* to permit the flow of fluid for at least some period of time prior to controlling the second solenoid 740*b* to permit the flow of fluid. However, in an embodiment further illustrated with respect to FIGS. 8 and 9, the control valve 336 could be operated according to a single switched (i.e., controlled by a solenoid or the like) fluid supply and still achieve the desired timing noted herein. In this embodiment, rather than being coupled directly to a second fluid supply source 726*b*, the second fluid passage 714 is in fluid communication with the control valve 336, as described below. An advantage, then, of the implementation illustrated in FIGS. 8 and 9 is that it permits the desired control of the extending and collapsing mechanisms 316, 318 using only a single fluid supply source.

Figure 8:
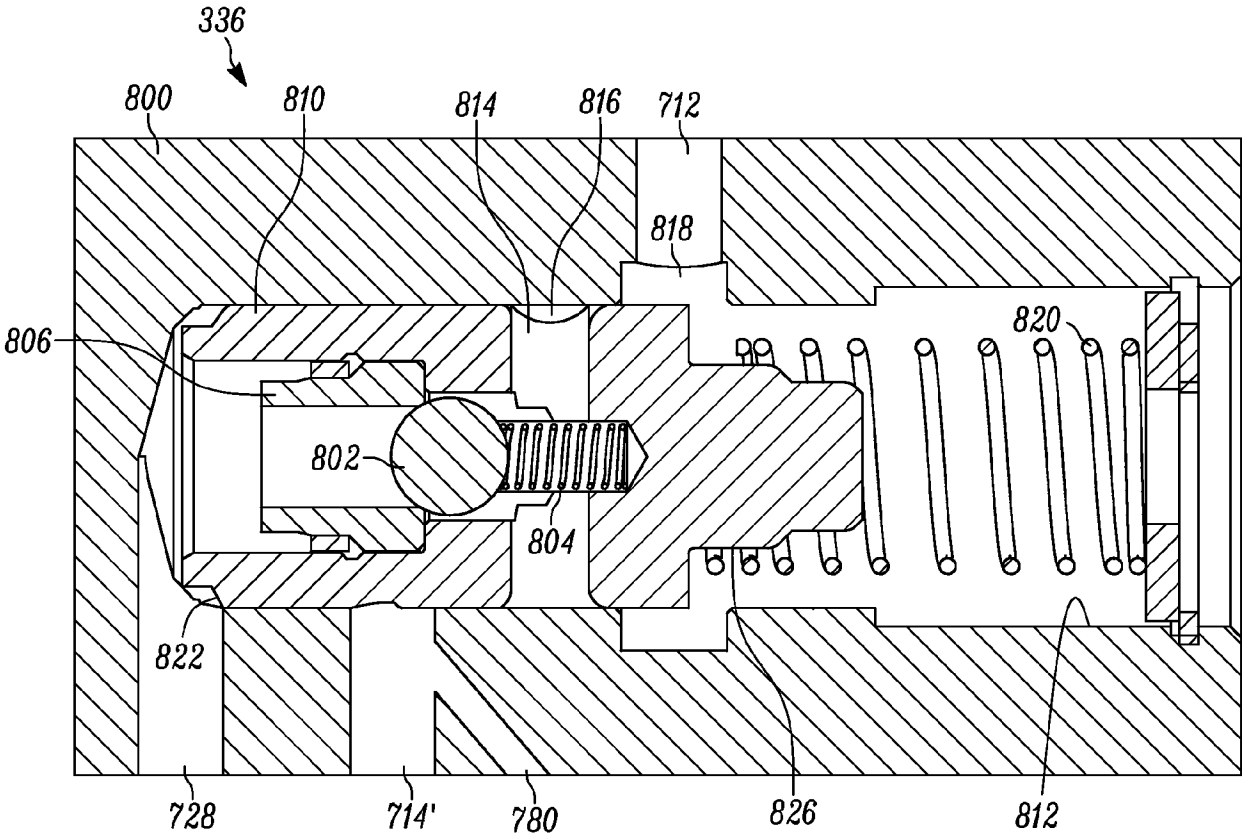
FIGS. 8 and 9 are magnified cross-sectional views of a control valve that may be used as a fluid supply component in accordance with various embodiments described herein.
Figure 9:
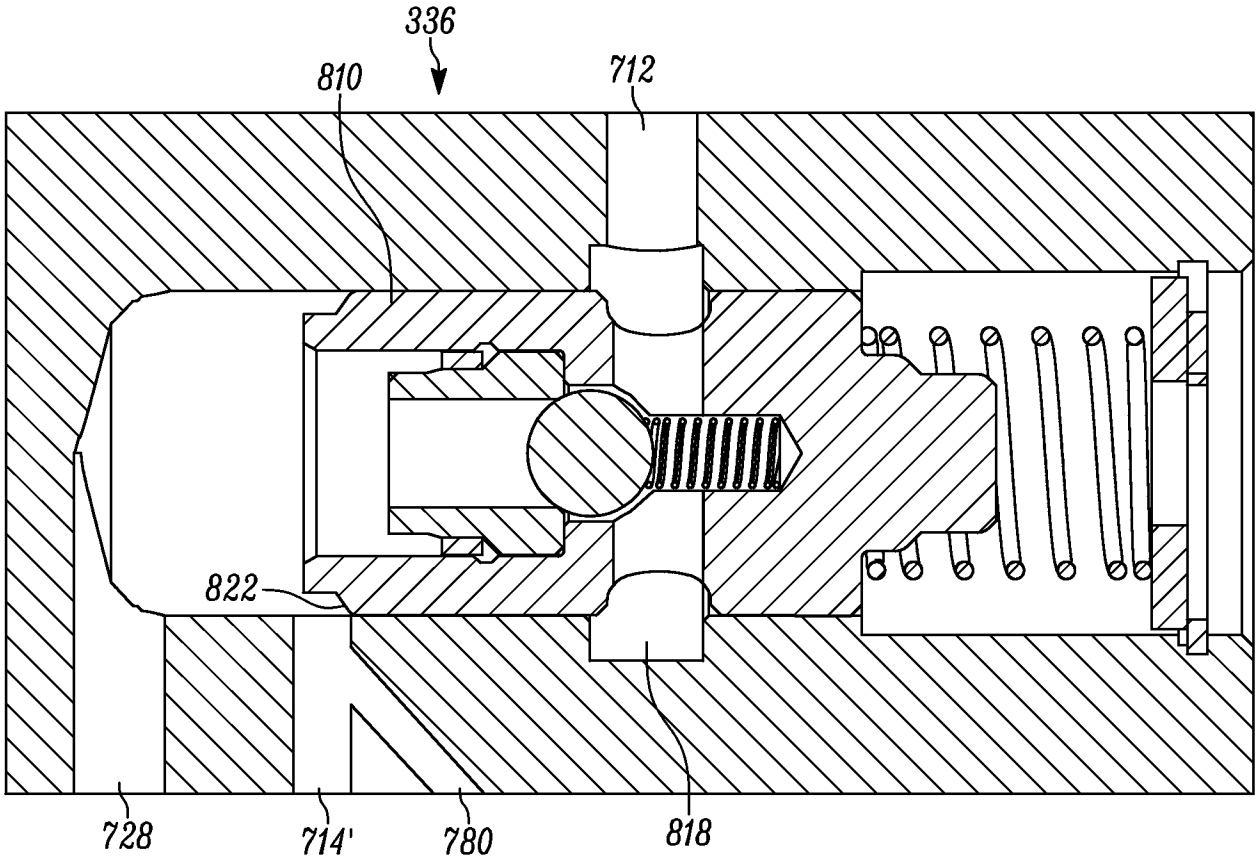

FIG. 8 is a cross-sectional view of a control valve 336 in accordance with an embodiment in which a single fluid supply source is used to provide staged or timed fluid supply to the extending and collapsing mechanisms 316, 318 described above. As illustrated, the control valve 336 includes a check valve having a check valve ball 802 and check valve spring 804. The check valve ball 802 is biased by the check valve spring 804 into contact with a check valve seat 806 that is, in turn, secured with a retaining ring. As further shown, the check valve is in fluid communication with the first fluid supply passage 728. In the illustrated embodiment, the check valve resides within a control valve piston 810 that is itself disposed within a control valve bore 812 formed in the control valve boss 800. A control valve spring 820 is also disposed within the control valve bore 812, thereby biasing the control valve piston 810 into a resting position (i.e., toward the left in FIG. 8). A washer and retaining ring may be provided opposite the control valve piston 810 to retain the control valve spring 820 within the control valve bore 812 and, as described below, to provide a pathway for hydraulic fluid to escape the control valve housing 800.

When present, the fluid in the first fluid supply passage 728 is sufficiently pressurized to overcome the bias of the check valve spring 804 causing the check valve ball 802 to displace from the seat 806, thereby permitting fluid to flow into a transverse bore 814 formed in the control valve piston 810 and then into a first circumferential, annular channel 816 also formed in the control valve piston 810. Simultaneously, the presence of the fluid in the fluid supply passage 808 causes the control valve piston 810 to overcome the bias provided by the control valve spring 820, thereby permitting the control valve piston 810 to displace (toward the right in FIG. 8) such that the first annular channel 816 begins to establish fluid communication with a second, circumferential annular channel 818 formed in the interior wall defining the control valve bore 812. Once fluid communication between the first and second annular channels 816, 818 has begun, the fluid is free to flow into, and thereby charge, the first fluid passage 712, which, as shown, is in fluid communication with the second annular channel 818.

While in its resting position, and further when the first and second annular channels 816, 818 first begin fluid communication, the control valve piston 810 blocks fluid communication between the first fluid supply passage 728 and the second fluid passage 714'. Under the pressure of the fluid from the first fluid supply passage 728, the control valve piston 810 continues to displace and, as it does so, a trailing edge 822 will eventually begin to move past the opening of the second fluid passage 714', thereby providing fluid communication between the first fluid supply passage 728 and the second fluid passage 714'. Consequently, the second fluid passage 714' begins to charge with fluid after the first fluid passage 712 has begun charging with fluid. FIG. 9 illustrates that point when the control valve piston 810 reaches a hard stop and is no longer able to displace. At that time, the first and second annular channels 816, 818 are substantially aligned and the trailing edge 822 no longer provides any obstruction to the second fluid passage 714'. As those of ordinary skill in the art will appreciate, configuration of the trailing edge 822 as well as the strength of the control valve spring 820 relative to the incoming pressurized fluid will dictate the period of time between the start of fluid flow into the first fluid passage 712 and the start of fluid flow into the second fluid passage 714'

Once the first and second fluid passages 712, 714' have been filled, the pressure gradient across the check valve ball 802 will equalize, thereby permitting the check valve ball 802 to re-seat and substantially preventing the escape of the hydraulic fluid from the first fluid passage 712. Assuming the relative non-compressibility of the fluid, the charged first fluid passage 712, in combination with the now-filled bore 760, essentially forms a rigid connection between the control valve piston 810 and the actuator piston 762 such that motion applied to the rocker arm 302 (as provided, for example, by the auxiliary valve actuation motion source 106) is transferred through the actuator piston 762 to the sliding pin 510. At the same time, the fluid in the second fluid passage 714' remains at the lower pressure of the first fluid supply passage 728. Assuming that the collapsing mechanism 318 comprises a wedge locking mechanism of the type described in the '982 application, the presence of the low pressure fluid in the second fluid passage 714' unlocks the wedge locking mechanism, thereby permitting the collapsing piston 319 to retract.

FIGS. 8 and 9 further illustrate how the control valve 336 may be utilized to provide lubrication (in the case where the fluid provided to the control valve 336 comprises, for example, engine oil) to the fixed member 324. As shown, an additional fluid passage 780 may be provided branching from the second fluid passage 714', which additional fluid passage 780 is further in communication with the contact surface of the fixed member 324. In this manner, the desired lubrication is provided to the contact surface only when needed, i.e., when charging of the second fluid passage 714 causes the collapsing mechanism 318 to collapsed or unlock such that the contact surface of the fixed member 324 is brought into contact with the auxiliary valve actuation motion source.

Regardless, when the supply of pressurized fluid is removed from the first fluid supply passage 728, the decrease in pressure presented to the control valve piston 810 allows the control valve spring 820 to once again bias the control valve piston 810 back to its resting position. In turn, this causes a reduced-diameter portion 826 of the control valve piston 810 to align with the second annular channel 818, thereby permitting the hydraulic fluid within the first fluid passage 712 to be released out of the open end of the control valve bore 812. The depressurization of the first fluid passage 712 breaks the hydraulic lock between the control valve piston 810 and the actuator piston 762, thereby permitting the actuator piston 762 to once again assume its retracted position. As the trailing edge 822 of the control valve piston 810 once again occludes the second fluid passage 714', the pressurized fluid of the first fluid supply passage 728 is no longer able to flow into the second fluid passage 714'. In an embodiment, the presence of leakage paths within the collapsing mechanism 718 to which the second fluid passage 714' is connected permits the fluid now trapped in the second fluid passage 714' to more slowly drain away in comparison with the rapid depressurization of the first fluid passage 712 provided by the control valve piston 810. As the fluid leaks out of the second fluid passage 714', the fluid pressure therein will eventually fall below a threshold whereby the wedge locking mechanism in the collapsing mechanism 718 will re-lock itself, thereby maintaining the collapsing piston 319 in its extended position. As described above, in this condition, the combination of the extended collapsing mechanism 318 and the retracted extending mechanism 316 permits motion applied to the rocker arm (as provided, for example, by the primary valve actuation motion source 104) to be transferred through the primary valve actuator 324 to the valve bridge 508.

Figure 10:
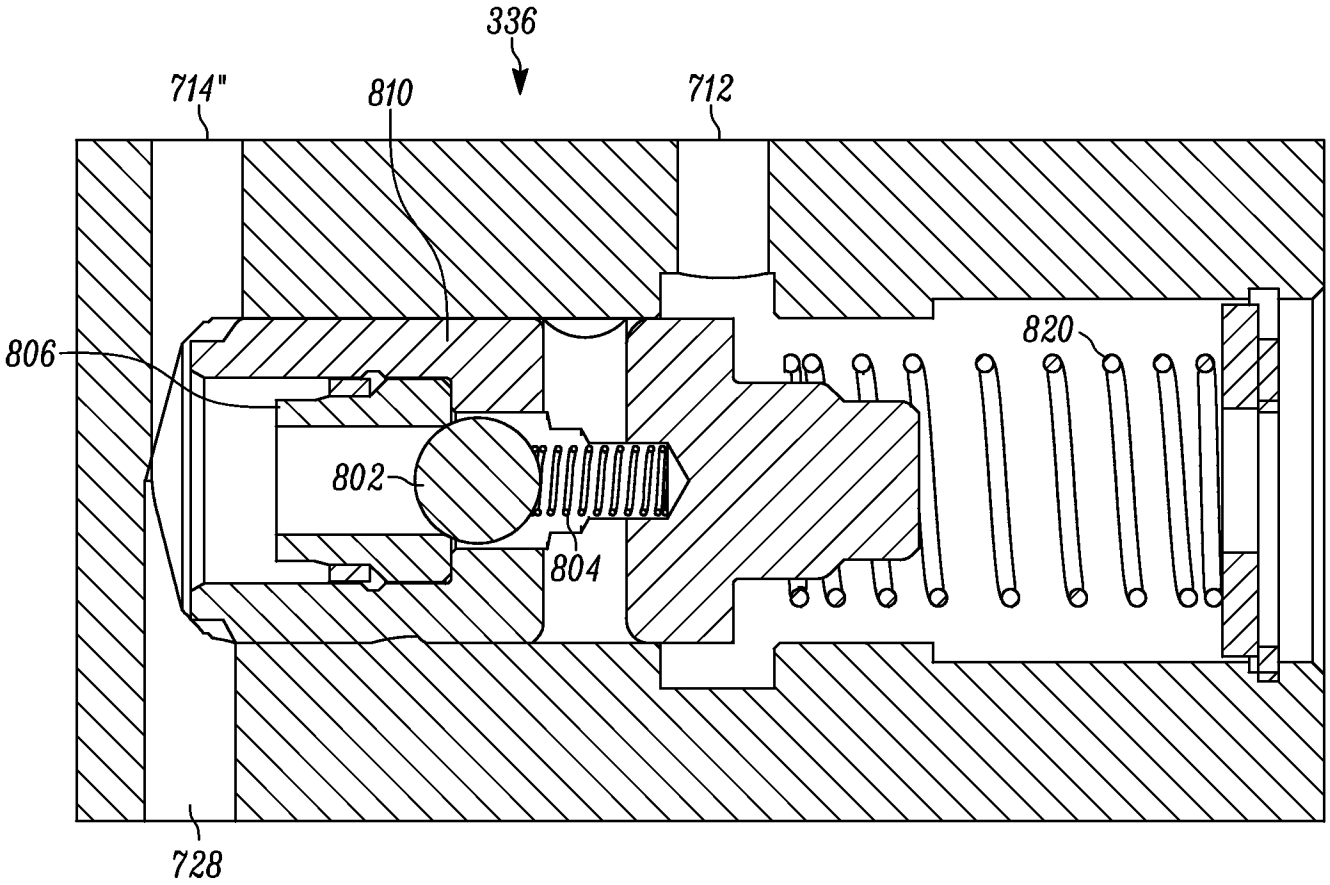
FIG. 10 is a magnified cross-sectional view of an alternative control valve that may be used as a fluid supply component in accordance with various embodiments described herein.

In an alternative to the fluid provision timing implemented by the embodiment of FIGS. 8 and 9, it may be desirable to instead initiate actuation of the collapsing mechanism 318 (i.e., to assume its unlocked or retracted state) prior to, or at least no later than, initiating actuation of the extending mechanism 316 (i.e., to assume its extended state). An example of a control valve 336 for this purpose is illustrated in FIG. 10, where like reference numerals refer to like components. In this implementation, however, the second fluid passage 714" is configured so that it will be charged with fluid prior to charging of the first fluid passage 712. More specifically, as fluid is introduced by the first fluid supply passage 728, charging of the second fluid passage 714" will occur prior to the control valve piston 810 displacing to a sufficient degree to permit fluid to flow into the first fluid passage 712 (even assuming that the bias of the check valve spring 804 is overcome to allow the check valve ball 802 to displace from the seat 806). Once again, configuration of the control valve piston 810 (i.e., the amount of displacement required prior to charging of the first fluid supply passage 712) as well as the relative stiffness of the control valve spring 820 may be selected to provide a desired degree of delay between charging of the respective first and second fluid passages.

Figure 11:
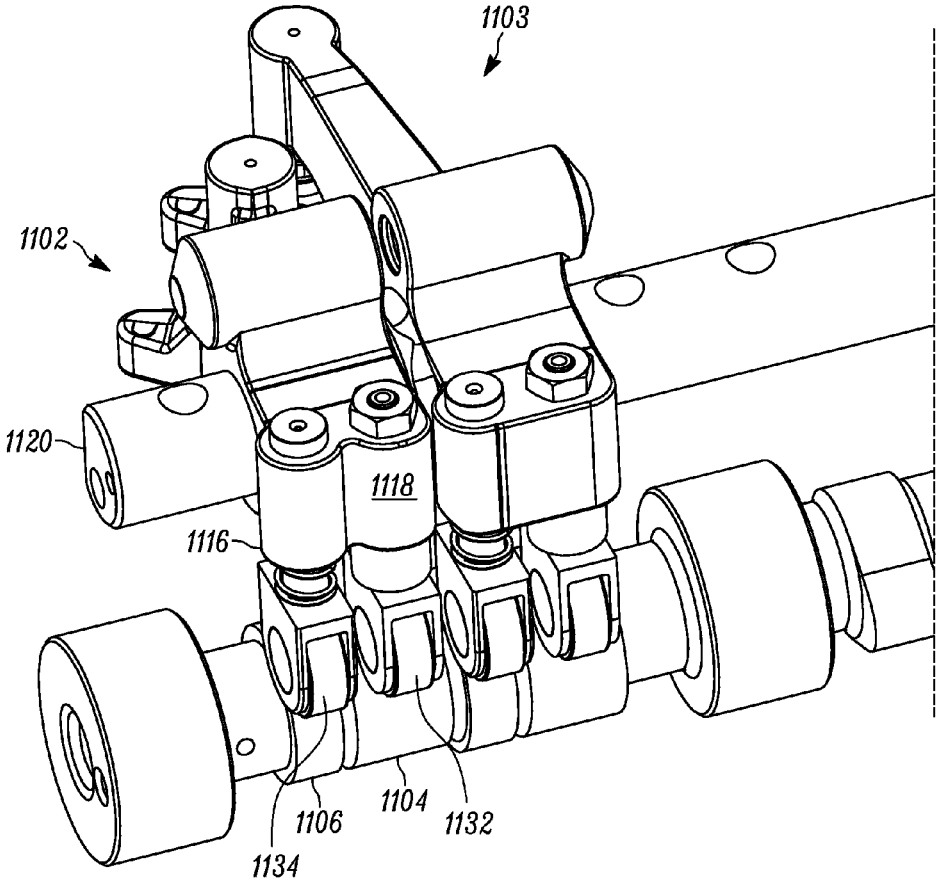
FIG. 11 is a top perspective view of an implementation of exhaust and intake rocker arms in accordance with the second embodiment of the instant disclosure.
Figure 12:
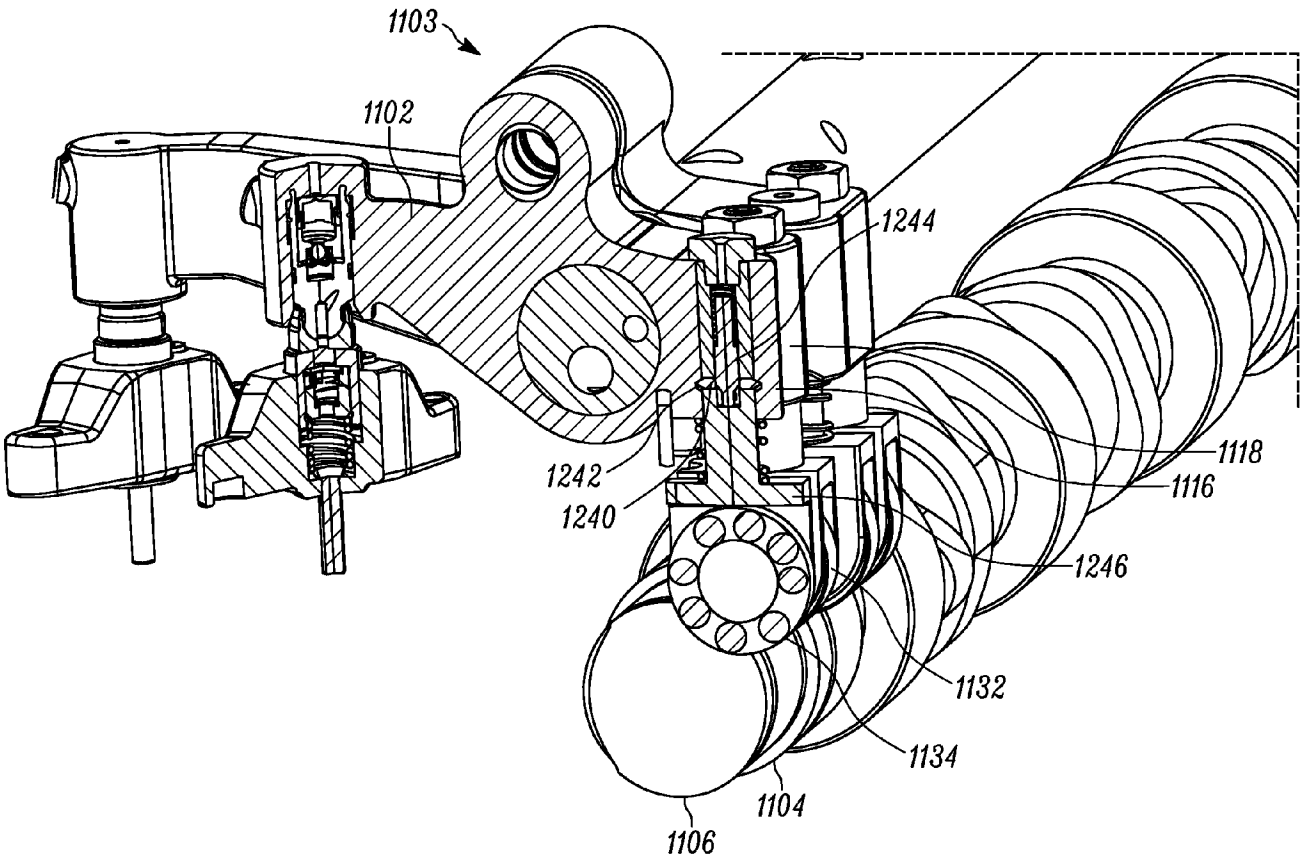
FIGS. 12 and 13 are top perspective, partial cross-sectional views of the implementation of FIG. 11 and further illustrating an example of a collapsing mechanism.
Figure 13:
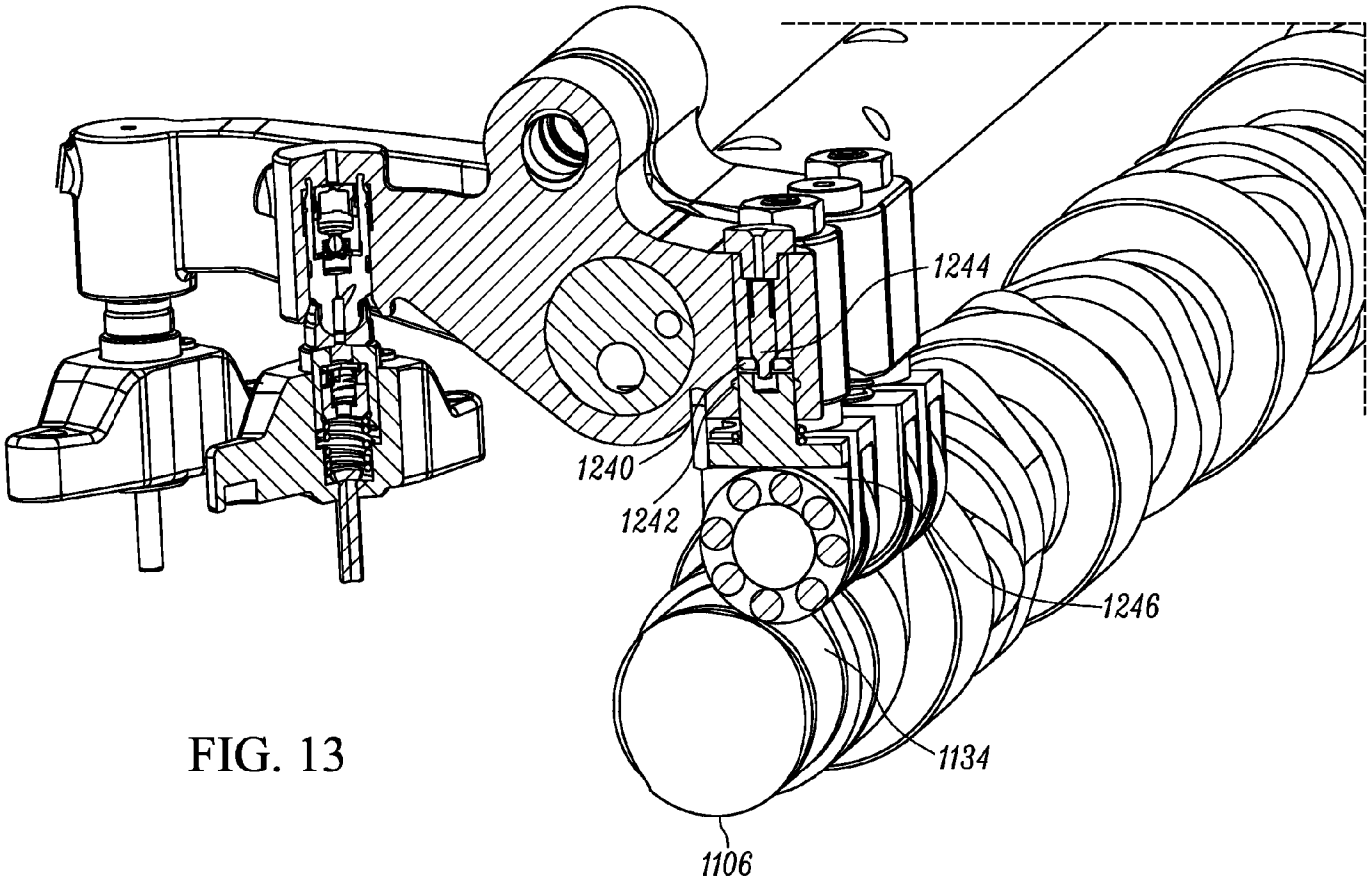

Referring now to FIGS. 11-13, an implementation in accordance with the second embodiment of FIG. 2 is illustrated. FIG. 11 illustrates an exhaust rocker arm 1102 and an intake rocker arm 1103 having similar constructions. As shown, both rocker arms 1102, 1103 reside on a rocker arm shaft 1120 that is configured to supply fluid to the rocker arms 1102, 1103 in accordance with the techniques described hereinabove. Further, with reference to the components of the exhaust rocker arm 1102 only, both rocker arms 1102, 1103 in the illustrated embodiment comprise an extending mechanism 1116 and a collapsing mechanism 1118 on the motion receiving end 112 of the rocker arm 1102, 1103. Further still, the primary valve actuation motion source 1104 and the auxiliary valve actuation motion source 1106 are illustrated as cams on a camshaft. Consequently, the extending mechanism 1116 and the collapsing mechanism 1118 respectively comprise contact surfaces in the form of cam rollers 1132, 1134. Once again, the particular form of the contact surfaces used by the extending mechanism 1116 and the collapsing mechanism 1118 will be dictated by the corresponding form of the valve actuation motion sources 1104, 1106. An advantage of the configuration of FIGS. 11-13 is that the relative compactness of the rocker arms 1102, 1103 facilitates their use in engine configurations that would normally not have adequate space for two rockers for each of the exhaust and intake rocker arm implementations.

With further reference to FIGS. 12 and 13, a partial cross-section view of the exhaust rocker arm 1102 is shown. In particular, the extending mechanism 1116 comprises a wedge locking mechanism of the type described in the '982 application, but in which the locking/unlocking function provided by the first fluid passage (not shown) is reversed. That is, when fluid is applied through the first fluid passage to the top of an inner plunger 1244, an increased-diameter portion of the inner plunger 1244 forces wedges 1240 maintained by an outer plunger 1246 (which, as shown, supports the cam roller 1134) into corresponding recesses 1242 formed in the rocker arm 1102, thereby locking the outer plunger into an extended position. In this extended position, the auxiliary cam roller 1134 is maintained in contact with the auxiliary valve actuation motion source 1106. However, as illustrated in FIG. 13, when the fluid is removed from the first supply passage and, consequently, the top of the inner plunger 1244, the inner plunger is biased by a spring upward such that a reduced-diameter portion of the inner plunger 1244 permits the wedges 1240 to retract into the outer plunger 1246, thereby disengaging the recesses 1242. Thus unlocked, the outer plunger is now free to retract such that the auxiliary cam roller 1134 is no longer maintained in contact with the auxiliary valve actuation motion source 1106.

In the embodiment of FIGS. 11-13, the collapsing mechanism 1118 may instead be implemented using a control valve/actuator piston combination as described above. In this manner, charging of the second fluid passage (not shown) would result in the collapsing mechanism 1118 being extended and hydraulically locked. Once again, however, this is not a requirement and the collapsing mechanism 1118 could also be implemented in a manner similar to the extending mechanism 1116.

FIGS. 12 and 13 further illustrate the use of an hydraulic lash adjuster (HLA) incorporated into the rocker arm 1102. In particular, as shown, the HLA is incorporated into the valve actuation end of the rocker arm 1102, though the hydraulic supply connections for the HLA are not illustrated. As known in the art, an HLA permits the automatic adjustment of lash space, thereby eliminating the need to manually adjust lash space. Such HLAs can be used in conjunction with either the first or second embodiments of FIGS. 1 and 2 at least in the manner depicted in FIGS. 12 and 13.

While particular preferred embodiments have been shown and described, those skilled in the art will appreciate that changes and modifications may be made without departing from the instant teachings. For example, the disclosure above focuses on two primary modes of operation, positive power generation and engine braking in which the relative states of the extending mechanism and the collapsing mechanism are always opposite each other, i.e., when one is extended, the other is retracted. However, there are cases where it may be desirable to maintain both the extending mechanism and the collapsing mechanism in the same state. For example, in cylinder deactivation it is desirable to remove a cylinder entirely from either positive power generation or engine braking. To this end, if both the extending mechanism and the collapsing mechanism are maintained in a retracted or unlocked state, it is possible to lose both the primary and auxiliary valve actuation motions. Conversely, if both the extending mechanism and the collapsing mechanism are maintained in an extended or locked state, it is possible to convey both the primary and auxiliary valve actuation motions, provided that that primary and auxiliary valve actuation motions do not conflict with each other or cause excessive opening of a valve. It is therefore contemplated that any and all modifications, variations or equivalents of the above-described teachings fall within the scope of the basic underlying principles disclosed above and claimed herein.

What is claimed is:

1. An apparatus for actuating at least one engine valve associated with an engine cylinder, comprising:

a rocker arm having a motion receiving end;

a collapsing mechanism disposed at the motion receiving end of the rocker arm to receive motion from a primary valve actuation motion source, the collapsing mechanism comprising a first piston slidably disposed in a fast bore formed in the rocker arm;

an extending mechanism disposed in the rocker arm to convey auxiliary valve actuation motion to the at least one engine valve, the extending mechanism comprising a second piston slidably disposed in a second bore formed in the rocker arm;

a first fluid passage in communication with the extending mechanism, wherein supply of fluid to the first fluid passage controls operation of the extending mechanism; and a second fluid passage, separate from the first fluid passage, in communication with the collapsing mechanism, wherein supply of fluid to the second fluid passage controls operation of the collapsing mechanism.

2. The apparatus of claim 1, wherein the extending mechanism is disposed at a valve actuation end of the rocker arm.

3. The apparatus of claim 2, wherein the extending mechanism is disposed in the rocker arm to actuate only a first engine valve of the at least one engine valve.

4. The apparatus of claim 2, the rocker arm further comprising a fixed member at the motion receiving end of the rocker arm, the fixed member comprising a contact surface to receive motion from an auxiliary valve actuation motion source.

5. The apparatus of claim 4, further comprising:

a control valve disposed in the rocker arm to supply and check fluid to the first fluid passage and to vent fluid from the first fluid passage when a source of fluid to the control valve is removed.

6. The apparatus of claim 5, wherein the control valve supplies fluid to the contact surface.

7. A system for actuating the at least one engine valve, comprising:

the apparatus of claim 4;

the primary valve actuation motion source; and the auxiliary valve actuation motion source.

8. The apparatus of claim 1, wherein the extending mechanism is disposed at the motion receiving end of the rocker arm to receive motion from an auxiliary valve actuation motion source.

9. The apparatus of claim 8, wherein the extending mechanism comprises a contact surface to receive motion from an auxiliary valve actuation motion source.

10. A system for actuating the at least one engine valve, comprising:

the apparatus of claim 8;

the primary valve actuation motion source; and the auxiliary valve actuation motion source.

11. The apparatus of claim 1, wherein the collapsing mechanism comprises a contact surface to receive the motion from the primary valve actuation motion source.

12. The apparatus of claim 1, further comprising:

a control valve disposed in the rocker arm to supply and check fluid to the first fluid passage and to vent fluid from the first fluid passage when a source of fluid to the control valve is removed.

13. The apparatus of claim 12, wherein the control valve supplies fluid to the first fluid passage and the second fluid passage.

14. The apparatus of claim 13, wherein the control valve supplies fluid to the second fluid passage after supplying fluid to the first fluid passage.

15. The apparatus of claim 13, wherein the control valve supplies fluid to the first fluid passage after supplying fluid to the second fluid passage.

16. The apparatus of claim 12, wherein the rocker arm receives a rocker arm shaft, the rocker arm further comprising a fluid supply passage providing fluid communication between a fluid supply source in the rocker arm shaft and the control valve.

17. The apparatus of claim 12, wherein the rocker arm receives a rocker arm shaft, and the rocker arm further comprises a first fluid supply passage providing fluid communication between a first fluid supply source in the rocker arm shaft and the control valve, and wherein the second fluid passage is in fluid communication with a second supply source in the rocker arm shaft.

18. The apparatus of claim 1, the rocker arm further comprising a primary valve actuator at the valve actuation end of the rocker arm to convey primary valve actuation motions to the at least one valve.

19. The apparatus of claim 1, wherein the rocker arm is an exhaust rocker arm.

20. The apparatus of claim 1, wherein the rocker arm is an intake rocker arm.

21. The apparatus of claim 1, further comprising an hydraulic lash adjuster disposed at a valve actuation end of the rocker arm.

* * * * *